United States Patent [19]

Coller et al.

[11] Patent Number: 4,557,542

[45] Date of Patent: Dec. 10, 1985

[54] CONNECTOR WITH MEANS FOR RETAINING TERMINALS AND VERIFYING SEATING

[75] Inventors: James R. Coller; Paul A. Coon, both of Kernersville, N.C.

[73] Assignee: AMP Incorporated, Harrisburg, Pa.

[21] Appl. No.: 618,984

[22] Filed: Jun. 11, 1984

[51] Int. Cl.[4] ..... H01R 11/00

[52] U.S. Cl. ..... 339/59 M; 339/217 S

[58] Field of Search ..... 339/59, 62, 63, 196 R, 339/196 M, 206 R, 206 P, 210 R, 210 M, 217 R, 217 S, 217 PS, 221 R, 221 M

[56] References Cited

U.S. PATENT DOCUMENTS

| | | | |
|---|---|---|---|
| 3,601,760 | 8/1971 | Cairns | 339/59 |
| 3,937,545 | 2/1976 | Cairns et al. | 339/60 R |
| 4,066,325 | 1/1978 | Pearce, Jr. et al. | 339/217 S |
| 4,343,523 | 8/1982 | Cairns et al. | 339/59 M |

*Primary Examiner*—Gil Weidenfeld
*Assistant Examiner*—Paula Austin
*Attorney, Agent, or Firm*—F. Brice Faller; Robert W. Pitts

[57] ABSTRACT

Electrical connector comprising housing with two rows of cavities having latch arms which retain terminals received therein and wedge means received in interstices between latch arms of adjacent rows. Wedge means cannot be fully received in interstices unless terminals are fully seated in cavities.

4 Claims, 6 Drawing Figures

CONNECTOR WITH MEANS FOR RETAINING TERMINALS AND VERIFYING SEATING

BACKGROUND OF THE INVENTION

The present invention relates to an electrical connector having rows of lead connected terminals in a housing, and more particularly to means for verifying seating of the terminals.

A known connector comprises an insulative housing having a or conductor receiving face and an opposed mating face with two rows of terminal receiving cavities extending between the faces, each cavity receiving a terminal from the conductor receiving face. Two adjacent rows of resilient latch arms in the housing flank respective cavities and cooperate with respective terminals to retain same when fully inserted. Each arm has a distal end toward the mating face and is separated from the adjacent arm by an interstice in the housing, each arm deflecting into the interstice during insertion of a terminal and returning toward the respective cavity when the terminal is fully inserted.

The known connector is intended for mating with an array of spade contacts which are received by the terminals in the housing through the mating face. While the latch arms provide for retention of the terminals to resist backing out during mating with the spade contacts, the retention is not positive insofar as there is nothing in the interstices to prevent deflection of the latch arms therein. Further, there is no means for assuring that all terminals are fully seated in the housing. Incorporation of positive retention and seating verification means in the housing would be desirable to assure good electrical connection between the entire array of spade contacts and all leads terminated by the connector.

SUMMARY OF THE INVENTION

According to the invention, an electrical connector as defined above further comprises wedge means received in the mating face of the housing between the rows of cavities, the wedge means fitting in the interstices between adjacent latch arms. The wedge means or wedge bar comprises a plurality of wedges integrally molded with an elongate carrier which is received flushly in a channel in the mating face of the housing. The channel communicates with each interstice so the wedges can be received in respective interstices.

If a terminal is not fully inserted into its cavity, the associated latch arm will remain deflected in the interstice and prevent reception of the wedge bar in the mating face since a wedge will abut the distal end of the latch arm in the interstice. A pull test will readily indicate which terminal is not seated, and it may then be fully inserted. The wedge bar is received flushly in the mating face as wedges fill the interstices and prevent deflection of the latch arms therein to provide positive seating of the terminals. Detents on opposed lateral edges of one of the wedges cooperate with shoulders in a cavity to retain the wedge bar.

BRIEF DESCRIPTION OF THE DRAWINGS

Referring to FIG. 1, the connector comprises a housing 10 and a wedge bar 50, the housing having a top external sidewall 11, a bottom external sidewall 15, a mating face 16, and a conductor receiving face 18. A release arm 12, hinged toward mating face 16, is found in the prior art connector and is not relevant to the present invention. Two rows of cavities 20 extend between faces 16, 18 and have mouths 22 at mating face 16. The edges of mouths 22 are bevelled to facilitate reception of spade terminals (not shown). A channel 17 extends across the mating face 16 between rows of cavities 20 and communicates with each mouth 22.

Figure 1:
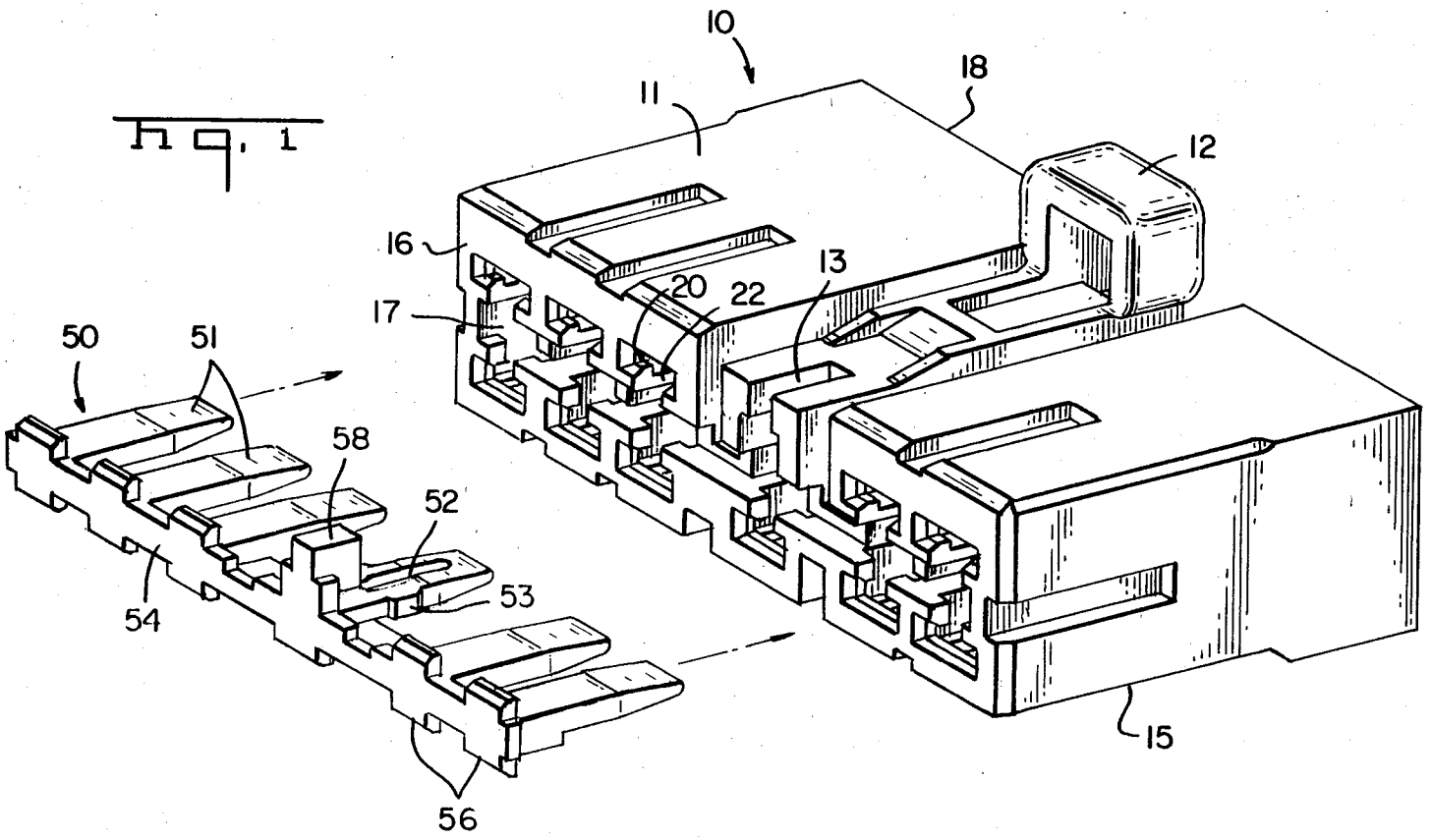
FIG. 1 is a perspective of the housing and wedge bar.

The wedge bar 50 comprises a row of wedges 51 spaced as the cavities 20 in each row in the housing 10. The wedges 51 are molded integrally with an elongate carrier 54, which further has flanges 56 on opposed edges thereof, which flanges 56 are received between the channel 17 and respective cavities 20 to define in part the mouths 22. One of the wedges 51 has detents 53 on lateral edges thereof and a slot 52 therein which permits inward flexing of the lateral edges so the detents can cooperate with shoulders (not shown) in the associated cavity 20 to retain the wedge bar 50 in the housing 10. A stud 58 on the carrier is received in slot 13 in the mating face 16, which slot 13 is deeper than the stud 58 and provides space to insert a pointed instrument to release the wedge bar 50.

Figure 2:
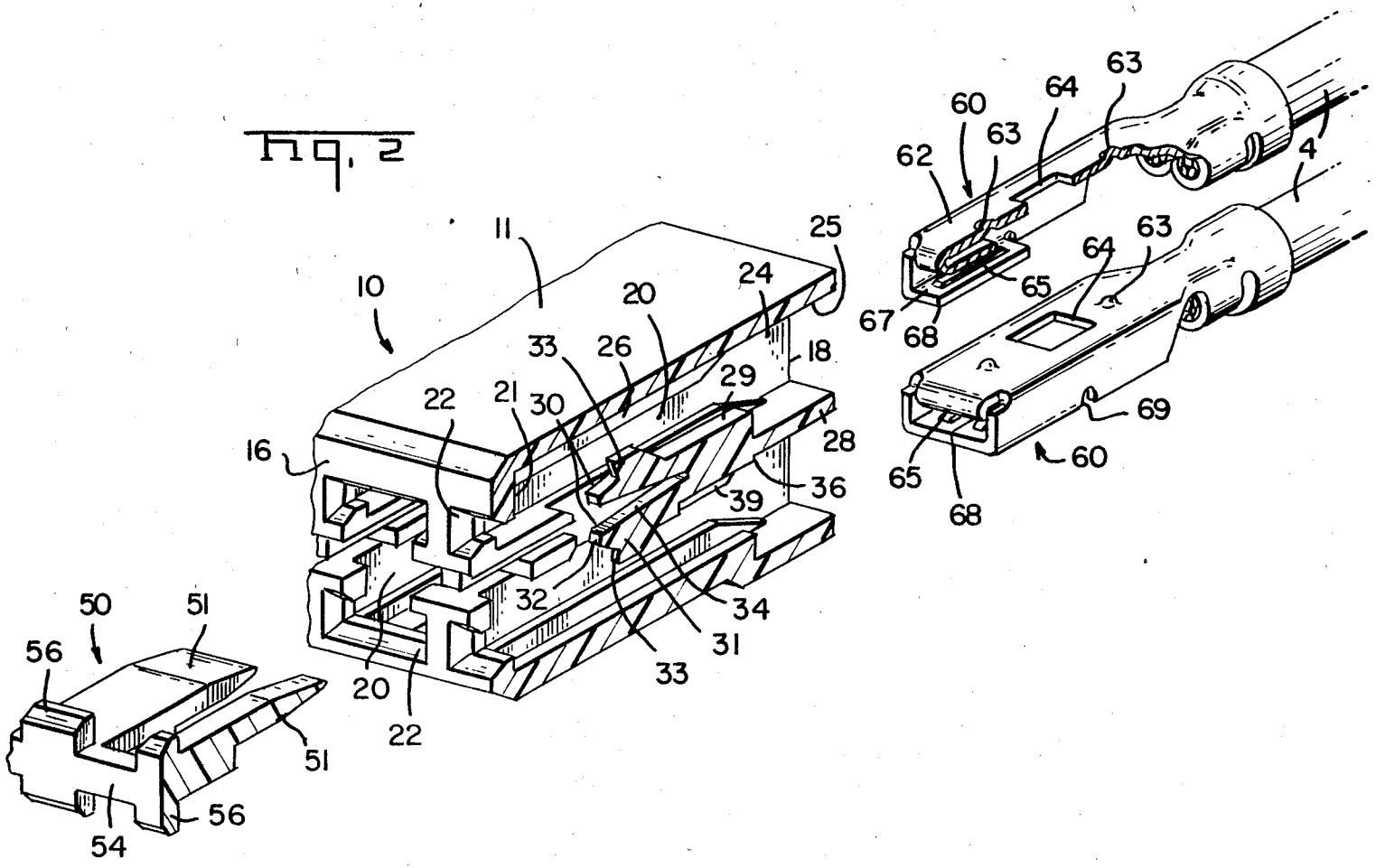
FIG. 2 is an exploded sectioned perspective of the housing, wedge bar, and terminated leads.

FIG. 2 is an exploded, sectioned perspective of the wedge bar 50, housing 10, and terminals 60 as terminated to associated leads 4. Each cavity 20 has an endwall 21 at the mating face 16, the mouths 22 being profiled in the endwall 21, and a terminal lead-in 24 at conductor receiving face 18. The cavities 20 in the top row each have a top internal sidewall 25 with an axial keying channel 26 therein and an intermediate wall 28 with a top surface 29 and a bottom surface 36, which surface 36 forms the top surface of an adjacent cavity 20 in the bottom row. Latch arms 31 with distal ends 32 toward mating face 16 are formed in the intermediate wall 28 by core pins entering from face 18 which form molding channels 30 on lateral edges of each latch arm 31. A core pin entering from face 16 forms the wedge-shaped interstice 34 between latch arms 31 flanking adjacent cavities 20 in adjacent rows. Each latch arm 31 has a distal end 32 facing mating face 16, which distal end 32 flexes into interstice 34 as a terminal 60 is inserted in the cavity 20. A shoulder 33 on each latch arm 31 provides anti-backout means for a terminal 60 when fully inserted.

Referring still to FIG. 2, the terminals 60 are stamped and formed from sheet metal and terminated to wire leads 4. Each terminal 60 comprises a top plate 62 from which a resilient contact tongue 65 is formed, and a bottom plate 67 having a seam 68 where the stamped stock is formed together. The top plates 62 have dimples 63 therein which must be aligned with channels 26, 39 in respective surfaces 25, 36 to assure reception of terminals 60 having like orientation, as shown. A latch hole 64 in top plate 62 and the rear edge 69 of bottom plate 67 provide edges which cooperate with shoulders 33 when the terminals 60 are fully inserted.

Figure 3:
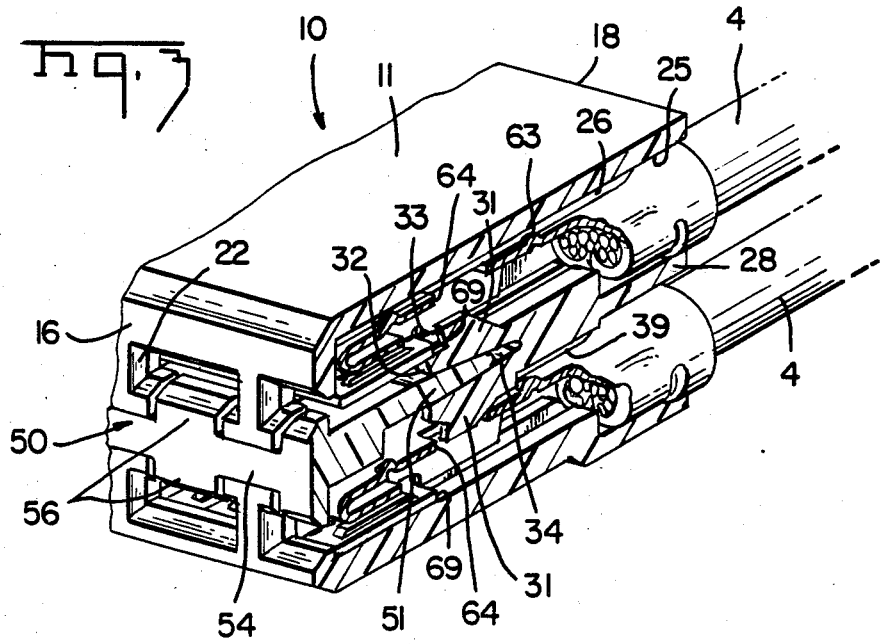
FIG. 3 is a sectioned perspective of the assembled housing, wedge bar, and terminated leads.

FIG. 3 is a cut away perspective of a fully assembled connector 6. Latch arms 31 are in their original undeflected state and shoulders 33 cooperate with hole 64 and rear edge 69 to prevent back-up as described. The wedge bar 50 is fully inserted in mating face 16, each wedge 51 fitting snugly in a wedge-shaped interstice 34 to prevent the latch arms 31 from deflecting therein. Flanges 56 on elongate carrier 54 define in part the mouths 22 of cavities 20. The space occupied by flanges 56 is left open in the prior art connector due to the necessity of core pins entering here to form the distal ends 32 of the latch arms 31.

Figure 4A:
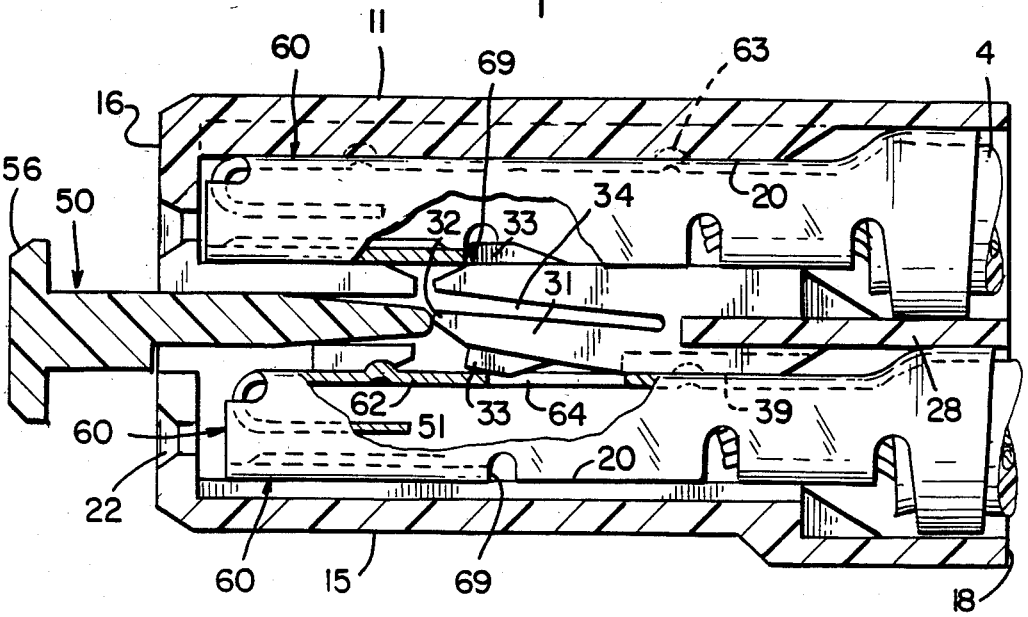
FIG. 4A is a side cross section showing a partially inserted terminal.
Figure 4B:
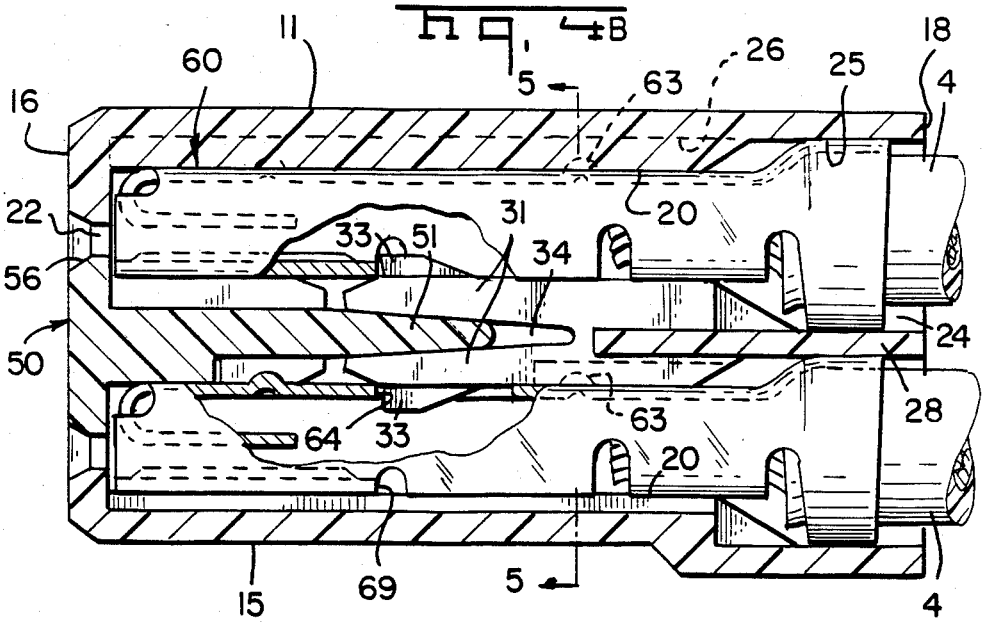
FIG. 4B is a side cross section showing fully inserted terminals.

FIG. 4A illustrates the result of attempting to insert a wedge bar 50 when one of the terminals 60 is not fully inserted. When a terminal 60 is not seated, the associated latch arm 31 remains deflected in the associated interstice 34, and the distal end 32 prevents entry of a wedge 51. When the terminal 60 is seated as shown in FIG. 4B, the shoulder 33 deflects into hole 64 in top plate 62, and the distal end 32 deflects out of interstice 34 so the wedge 51 can enter as shown. In order for wedge bar 50 to be received as shown, all interstices 34 must be clear, thus assuring that all terminals 60 are seated.

Figure 5:
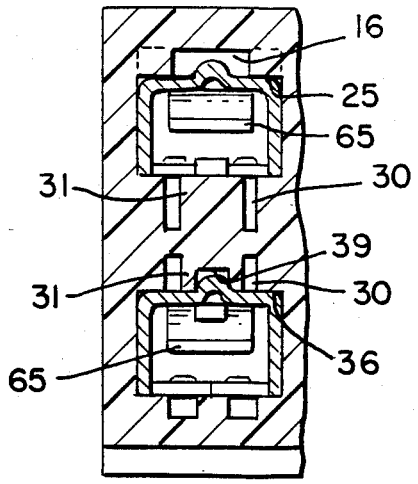
FIG. 5 is an end cross section showing terminal keying.

FIG. 5 is a partial end cross section of the assembled connector 6. Keying channels 26, 39 in respective surfaces 25, 36 receive dimples 63 to assure orientation as shown. The molding slots 33 formed by core pins during manufacture of the housing define lateral edges of the latch arms 31.

We claim:

1. An electrical connector of the type comprising an insulative housing having a mating face and an opposed conductor receiving face, the mating face being defined by an endwall, two rows of terminal receiving cavities extending between said faces, each cavity receiving a terminal therein from said conductor receiving face, each cavity communicating with an open mouth in said endwall, said housing having two adjacent rows of resilient latch arms therein, each latch arm flanking a respective cavity and cooperating with a terminal therein to retain same therein when fully inserted, each arm having a distal end toward said mating face, each arm being separated from the adjacent arm by an interstice in the housing, each arm deflecting into the interstice during insertion of a terminal, and returning toward the respective cavity when the terminal is fully inserted, the improvement comprising, wedge means received in the mating face of said housing between said rows of cavities, said wedge means fitting in said interstices between adjacent latch arms.

2. An electrical connector as in claim 1 wherein said wedge means comprises a plurality of wedges fixed to an elongate carrier, said housing having a channel in said mating face which receives said carrier flushly therein, said channel communicating with each interstice, said wedges being received in respective interstices.

3. An electrical connector as in claim 2 further comprising flange means on opposed edges of said elongate carrier, said flange means likewise being received in said mating face and defining in part the mouths of individual cavities of said mating face.

4. An electrical connector as in claim 2 wherein one of said wedges has detent means on opposed lateral edges thereof and a slot in the center of the wedge to permit inward flexure of said lateral edges.

* * * * *